United States Patent [19]

Tenhover et al.

[11] Patent Number: 4,537,624

[45] Date of Patent: Aug. 27, 1985

[54] AMORPHOUS METAL ALLOY POWDERS AND SYNTHESIS OF SAME BY SOLID STATE DECOMPOSITION REACTIONS

[75] Inventors: Michael A. Tenhover; Richard S. Henderson, both of Solon; Robert K. Grasselli, Aurora, all of Ohio

[73] Assignee: The Standard Oil Company (Ohio), Cleveland, Ohio

[21] Appl. No.: 586,380

[22] Filed: Mar. 5, 1984

[51] Int. Cl.[3] ..... B22F 3/24; B22F 9/00

[52] U.S. Cl. ..... 75/0.5 B; 75/251; 148/11.5 P; 148/403

[58] Field of Search ..... 75/0.5 B, 0.5 BA, 0.5 BB, 75/0.5 BC, 251, 252; 148/403, 11.5 P

[56] References Cited

U.S. PATENT DOCUMENTS 4,197,146 4/1980 Frischman ..... 75/251

4,282,034 8/1981 Smith et al. ..... 75/251

*Primary Examiner*—Wayland Stallard

*Attorney, Agent, or Firm*—T. P. Schur; J. G. Curatolo; L. W. Evans

[57] ABSTRACT

Amorphous metal alloy powders are synthesized by solid state decomposition reactions. At least one precursor compound is thermally decomposed at a temperature below the crystallization temperature of the amorphous metal alloy to be formed. The decomposition product comprises an intimate mixture of the elements of the alloy and, after heat-treating if necessary, exhibits amorphous characteristics.

44 Claims, No Drawings

AMORPHOUS METAL ALLOY POWDERS AND SYNTHESIS OF SAME BY SOLID STATE DECOMPOSITION REACTIONS

FIELD OF THE INVENTION

This invention relates to amorphous metal alloy powders and the novel preparation of such powders by solid state reactions. More specifically, this invention relates to the synthesis of amorphous metal alloy powders by the thermal decomposition of metal-bearing compounds.

BACKGROUND OF THE INVENTION

Amorphous metal alloy materials have become of interest in recent years due to their unique combinations of mechanical, chemical and electrical properties that are especially well-suited for newly-emerging applications. Examples of amorphous metal material properties include the following:

uniform electronic structure,
compositionally variable properties,
high hardness and strength,
flexibility,
soft magnetic and ferroelectric properties,
very high resistance to corrosion and wear,
unusual alloy compositions, and
high resistance to radiation damage.

These characteristics are desirable for applications such as low temperature welding alloys, magnetic bubble memories, high field superconducting devices and soft magnetic materials for power transformer cores.

The unique combination of properties of amorphous metal alloy materials may be attributed to the disordered atomic structure of amorphous materials which ensures that the material is chemically homogeneous and free from the extended defects, such as dislocations and grain boundaries, that are known to limit the performance of crystalline materials. The amorphous state is characterized by a lack of long range periodicity, whereas a characteristic of the crystalline state is its long range periodicity.

Generally, the room temperature stability of amorphous materials depends on various kinetic barriers to the growth of crystal nuclei and to nucleation barriers that hinder the formation of stable crystal nuclei. Such barriers typically are present if the material to be made amorphous is first heated to a molten state then rapidly quenched or cooled through the crystal nucleation temperature range at a rate that is sufficiently fast to prevent significant nucleation to occur. Such cooling rates are on the order of $10^{6}$° C./second. Rapid cooling dramatically increases the viscosity of the molten alloy and quickly decreases the length over which atoms can diffuse. This has the effect of preventing crystalline nuclei from forming and yields a metastable, or amorphous, phase.

Processes that provide such cooling rates include sputtering, vacuum evaporation, plasma spraying and direct quenching from the liquid state. It has been found that alloys produced by one method often cannot be similarly produced by another method even though the pathway to formation is in theory the same.

Direct quenching from the liquid state has found the greatest commercial success since a variety of alloys are known that can be manufactured by this technique in various forms such as thin-films, ribbons and wires. U.S. Pat. No. 3,856,513 to Chen et al. describes novel metal alloy compositions obtained by direct quenching from the melt and includes a general discussion of this process. Chen et al. describes magnetic amorphous metal alloys formed by subjecting the alloy composition to rapid cooling from a temperature above its melting temperature. A stream of the molten metal is directed into the nip of rotating double rolls maintained at room temperature. The quenched metal, obtained in the form of a ribbon, was substantially amorphous as indicated by X-ray diffraction measurements, was ductile, and had a tensile strength of about 350,000 psi.

U.S. Pat. No. 4,036,638 to Ray et al. describes binary amorphous alloys of iron or cobalt and boron. The claimed amorphous alloys were formed by a vacuum melt-casting process wherein molten alloy was ejected through an orifice and against a rotating cylinder in a partial vacuum of about 100 millitorr. Such amorphous alloys were obtained as continuous ribbons and all exhibited high mechanical hardness and ductility.

The thicknesses of essentially all amorphous foils and ribbons formed by rapid cooling from the melt are limited by the rate of heat transfer through the material. Generally the thickness of such films is less than 50 $\mu$m. The few materials that can be prepared in this manner include those disclosed by Chen et al. and Ray et al.

Amorphous metal alloy materials prepared by electrodeposition processes have been reported by Lashmore and Weinroth in Plating and Surface Finishing, 72 (August 1982). These materials include Co—P, Ni—P, Co—Re and Co—W compositions. However, the as-formed alloys are inhomogeneous and so can be used in only a limited number of applications.

The above-listed prior art processes for producing amorphous metal alloys depend upon controlling the kinetics of the solidification process; controlling the formation of the alloy from the liquid (molten) state or from the vapor state by rapidly removing heat energy during solidification. Most recently, an amorphous metal alloy composition was synthesized without resort to rapid heat removal. Yeh et al. reported that a metastable crystalline compound $Zr_3Rh$, in the form of a thin-film, could be transformed into a thin-film, amorphous metal alloy by the controlled introduction of hydrogen gas; Applied Physics Letter 42(3), pp 242–244, Feb. 1, 1983. The amorphous metal alloy had an approximate composition of $Zr_3RhH_{5.5}$.

Yeh et al. specified three requirements as prerequisities for the formation of amorphous alloys by solid state reactions: at least a three component system; a large disparity in the atomic diffusion rates of two of the atomic species; and an absence of a polymorphic crystalline alternative as a final state. Thus, Yeh et al. teach that solid state reactions would have limited applications for the synthesis of amorphous metal alloy materials.

The known amorphous metal alloys and processes for making such alloys which are discussed above suffer from the disadvantage that the so-formed amorphous alloy is produced in a limited form, that is as a thin-film such as a ribbon, wire or platelet. These limited shapes place severe restrictions on the applications for which amorphous metal materials may be used.

To produce bulk amorphous metal alloy objects the formed amorphous alloy must be mechanically reduced to a powder as by chipping, crushing, grinding and ball milling and then recombined in the desired shape. These are difficult processes when it is realized that most amorphous metal alloys have high mechanical strengths and also possess high hardnesses.

What is lacking in the area of amorphous metal alloy preparation is a simple process for the direct formation of a large variety of amorphous metal alloys. Especially lacking is a process that would synthesize amorphous metal alloy materials directly as powders suitable for forming bulk amorphous metal alloy shapes.

Hence, it is one object of the present invention to provide novel amorphous metal alloy compositions.

It is another object of the present invention to provide a process for the direct preparation of a large variety of homogeneous amorphous metal alloy compositions.

It is a further object of the present invention to provide a process for the direct preparation of a large variety of homogeneous amorphous metal alloy compositions in a powder form.

It is still another object of the present invention to provide a process for the direct preparation of a large variety of homogeneous amorphous metal alloy powders by solid state reactions.

These and additional objects of the present invention will become apparent in the description of the invention and examples that follow.

SUMMARY OF THE INVENTION

The present invention relates to a process for the synthesis of a substantially amorphous metal alloy comprising thermally decomposing at least one precursor metal-bearing compound at a temperature below the crystallization temperature of the amorphous metal alloy to be formed, the at least one precursor metal-bearing compound having a decomposition temperature below the crystallization temperature of the amorphous alloy to be formed and containing the metals which comprise the substantially amorphous metal alloy.

This invention also relates to a process for the synthesis of a substantially amorphous metal alloy comprising the steps of:

(a) decomposing at least one precursor metal-bearing compound at a temperature below the crystallization temperature of the amorphous metal alloy to be synthesized so as to form an intimate mixture of the components of the amorphous metal alloy to be synthesized, the at least one precursor metal-bearing compound containing the metals which comprise the substantially amorphous alloy; and (b) heat-treating the intimate mixture so as to form the amorphous metal alloy.

The processes disclosed herein provide for the synthesis of substantially amorphous metal alloy compositions as powders which may then be readily used to form bulk amorphous metal alloy shapes.

DETAILED DESCRIPTION OF THE INVENTION

In accordance with this invention, there are provided novel processes for the synthesis of substantially amorphous metal alloys. The term "substantially" as used herein in reference to the synthesized amorphous metal alloys means that the synthesized alloys are at least fifty percent amorphous, preferably at least eighty percent amorphous and most preferably about one hundred percent amorphous, as indicated by X-ray diffraction analyses. The use of the phrase "amorphous metal alloys" as used herein refers to amorphous metal-containing alloys that may also comprise non-metallic elements. Amorphous metal alloys may include non-metallic elements such as boron, carbon, nitrogen, silicon, phosphorus arsenic, germanium and antimony.

The solid state processes disclosed herein include the step of thermally decomposing at least one metal-bearing compound at a temperature below the crystallization temperature of the amorphous metal alloy to be formed. The at least one precursor metal-bearing compound is preferably chosen so that its decomposition temperature is at least 25° C. below the crystallization temperature of the amorphous metal alloy to be formed and most preferably is at least 100° C. below the crystallization temperature of the amorphous metal alloy to be formed.

Typical precursor metal-bearing compounds have decomposition temperatures between about 20° C. and about 500° C. A substantial number of precursor metal-bearing compounds suitable for use in the processes of this invention have decomposition temperatures between about 150° C. and about 400° C.

The thermal decomposition of the at least one precursor metal-bearing compound yields an intimate mixture of the components of the desired metal alloy. This decomposition step is preferably performed in a reactor having collection means so that about a one hundred percent yield of material will be realized. This may be achieved by maintaining a cooled reactor portion downstream of the thermal decomposition portion of the reactor wherein the thermally decomposed products will be deposited. Alternatively and most preferably, the decomposition step may be performed in a sealed reactor to prevent evaporation of the metal alloy components. Upon cooling, about a one hundred percent yield of the reaction products may be recovered therefrom.

The decomposition of the precursor compounds may occur under an atmosphere suitable for the synthesis of the desired amorphous metal alloy. The precursor compounds may be disposed in a sealed reaction vessel that has been partially or fully evacuated prior to heating. If the amorphous metal alloy to be synthesized does not contain oxygen, then it is preferred that the thermal decomposition of the precursor compounds be done under an inert or reducing atmosphere or in a sealed reaction vessel that has been partially or fully evacuated. If some tolerance to oxygen is possible then an inert or reducing atmosphere or vacuum may not be necessary.

A precursor compound may also exist at room temperature in the gaseous state and may itself provide the initial atmosphere under which the thermal deomposition will be performed. In this manner, a reactive atmosphere exists for the thermal decomposition reaction. Precursor compounds may also be used that are solid at about 20° C., but which vaporize at slightly elevated temperatures. These compounds may be disposed in an evacuated reactor and upon heating, provide a reactive atmosphere for the decomposition reaction.

The precursor metal-bearing compounds suitable for use in this invention may include organometallic compounds such as monomers, dimers, trimers and polymers aving metallo-organic ligands composed of saturated and/or unsaturated hydrocarbons, aromatic or heretoaromatic ligands, and may also include oxygen, boron, carbon, nitrogen, phosphorus, arsenic, germanium, antimony and/or silicon-containing ligands, and combinations thereof. Precursor metal-bearing compounds may also be halogen compounds, oxides, nitrates, nitrides, carbides, borides or metal-bearing salts, with the restriction that the decomposition temperature of the precursor compound be less than the crystallization temperature of the amorphous metal alloy to be synthesized.

As disclosed earlier, precursor compounds may also be provided that do not contain a metal but which contribute a non-metallic element to the amorphous alloy composition.

The thermal decomposition of precursor compounds yields a product consisting essentially of the components of the desired amorphous metal alloy. The components are intimately mixed, the maximum size of the particles in the mixture preferably being from about 10 Angstroms to about 1000 Angstroms, and most preferably from about 10 Angstroms to about 500 Angstroms. These decomposition products may be represented by the following empirical formulae:

$$M_aX_{1-a}$$

wherein

M is at least one metal selected from the metals in Groups VI-B, VII-B, VIII, I-B and II-B of the Periodic Table;

X is at least one element selected from Groups III-A, IV-A and V-A of the Periodic Table; and wherein a ranges from about 0.1 to about 0.9;

and $$N_bY_{1-b}$$

wherein

N is at least one metal selected from the metals in Groups III-B, IV-B, V-B, and VI-B of the Periodic Table; and Y is selected from Groups VIII, I-B and II-B of the Periodic Table; and wherein b ranges from about 0.2 to about 0.8.

The thermal decomposition of the precursor compounds may occur at high enough temperatures and for a period of time long enough to permit alloying of the metal elements concurrent with the decomposition. Under such circumstances the product which results from the decomposition step is a substantially amorphous metal alloy.

This product is synthesized as a solid, powder material having a maximum particle size of from about 10 Angstroms to about 1000 Angstroms. This powder is suitable for compaction, with or without a binder, into a solid shape.

If the decomposition temperature is not sufficiently high, or the period of decomposition is too brief, to enable alloying of the reactant products during the decomposition of the precursor compounds, then the powder that is obtained is an intimate mixture comprising the alloy components. A subsequent heat-treating step at a temperature below the crystallization temperature of the amorphous metal alloy will allow diffusion of at least one metal component so as to form an amorphous metal alloy. This heat-treating step is carried out under an atmosphere conducive to the formation of the amorphous metal alloy. This may occur under vacuum conditions, from about 0 torr. to about 500 torr., or in an inert, reducing or reactive atmosphere.

Prior to the heat-treating step, the powder obtained from the decomposition of the precursor compounds may be pressed into a shape so that, upon heat-treating, a bulk amorphous metal alloy shape is obtained. It is also possible to compact the heat-treated amorphous metal alloy powder into a solid shape.

It has also surprisingly been found that the amorphous metal alloy products of thermal decomposition and decomposition/heat-treating processes may be mixed with another precursor metal-bearing compound to yield a new, enhanced amorphous metal alloy material which has incorporated into the prior amorphous metal alloy elements from the newly-added precursor. This may be accomplished by disposing the prior amorphous metal alloy in a reactor with the newly-added precursor metal-bearing compound and heat-treating this mixture at a temperature that will decompose the precursor compound but that is below the crystallization temperatures of the prior amorphous metal alloy and the enhanced amorphous metal alloy that is to be synthesized. The newly-added precursor may be a solid, liquid or gaseous material upon insertion into the reaction vessel. As with the above-discussion, the decomposition of the precursor material may occur in a partial of full vacuum, or under an inert, reducing, or reactive atmosphere.

The solid state reaction that occurs to alloy an intimate mixture of elements may be viewed by examining the free energy of the system. The intimate mixture of elements corresponds to a relatively high free energy of the system. At about room temperature such mixtures are generally kinetically restricted to this state. Adding energy to this system, as at the thermal decomposition temperature or during subsequent heat-treatments, allows the components to begin to inter-diffuse. The free energy of the system is lowered by an increase in the entropy of mixing and a decrease in the enthalpy due to the formation of heteropolar bonds. The absolute minimum in free energy in these systems will occur for the equilibrium crystalline alloys. For many alloy combinations, however, a local minimum in the free energy can exist in an amorphous phase. For alloy combinations such as these, the requirements for the formation of an amorphous phase by a solid state reaction are that the intimate mixture of components have a free energy higher than that of the amorphous phase and that the diffusion process to form the alloy be performed at temperatures sufficiently below the characteristics temperatures for the formation of crystalline nuclei.

The above-described processes for synthesizing amorphous metal alloys are not hindered by the processing limitations of prior art processes. The methods disclosed herein do not depend on extremely high cooling rates or heat transfer properties, nor is very high temperature or very low vacuum equipment necessary. Further, the processes of this invention provides for the synthesis of substantially amorphous metal alloy powders, which amorphous alloy powders may be pressed into desired shapes to form solid amorphous alloy shapes. Alternatively, the methods disclosed herein provide an intimate mixture of elements that may be formed into a desired shape and, upon subsequent heat-treating, may be converted into a substantially amorphous metal alloy shape. These bulk amorphous metal alloy shapes may find new and useful applications, since such shapes have not been conveniently fabricated by any other techniques.

EXAMPLES

The following examples more thoroughly illustrate the present invention and are not intended in any way to be limitative thereof. Each of the following examples describes the co-decomposition of organometallic compounds to yield amorphous metal alloy powders.

EXAMPLE 1

This example demonstrates the formation of an amorphous iron-molybdenum composition.

Equimolar amounts of about 2 mmol each of cyclopentadienyliron dicarbonyl dimer[$C_5H_5Fe(CO)_2]_2$ and cyclopentadienylmolybdenum tricarbonyl dimer[$C_5H_5Mo(CO_3)]_2$ were disposed in a stainless steel bomb reactor. The reactor was purged with argon and sealed under an argon atmosphere. The bomb reactor was then heated to a temperature of about 300° C. for about 24 hours. The decomposition temperature of cyclopentadienyliron dicarbonyl dimer is about 195° C., and the decomposition temperature of cyclopentadienylmolybdenum tricarbonyl dimer is about 180° C.

After cooling to about 20° C., the reactor was opened and a black-colored solid, in powder form, was removed therefrom. The power was washed with tetrahydrofuran to remove any organic-soluble materials, then dried at a temperature of about 60° C. under vacuum.

The powder was next divided into four fractions, a first friction was set aside for later analysis, and the other three fractions were further treated in the following manner; one fraction was heat-treated at about 270° C. under vacuum for about 168 hours, another fraction was heat-treated at about 325° C. under vacuum for about 168 hours, and still another fraction was heat-treated at about 800° C. under vacuum for about 10 minutes.

X-ray diffraction data indicated that the powder removed from the bomb reactor after co-decomposition of the precursor materials comprised an amorphous iron-molybdenum alloy having an approximate composition of $Fe_{50}Mo_{50}$. The fractions of the powder that were heat-treated at about 270° C. and about 325° C. were also found to comprise an amorphous iron-molybdenum alloy of approximate composition $Fe_{50}Mo_{50}$, as indicated by X-ray diffraction, but the fraction of the powder that was heat-treated at about 800° C. was crystalline.

Differential scanning calorimetry was implemented to determine that the amorphous alloy powder fractions had glass transition temperatures of about 325° C. and crystallization temperatures of about 420° C. Mössbauer Effect Spectra of the amorphous powder fractions indicated that these amorphous iron-molybdenum alloy powders have internal magnetic fields and magnetic moments similar to other iron-containing amorphous alloys.

Amorphous iron-molybdenum alloy compositions have not been reported as formed by any other method except sputtering, which method cannot synthesize the amorphous alloy in powder form.

EXAMPLE 2

This example demonstrates the formation of an amorphous iron-molybdenum composition using alternative precursor organometallic compounds.

Equimolar amounts of iron pentacarbonyl ($Fe(CO)_5$) and molybdenum carbonyl ($Mo(CO)_6$) could be sealed under an inert atmosphere such as an argon atmosphere or under a vacuum in a bomb reactor and heated to about 270° C. for about 120 hours to thermally decompose about all of the precursor compounds and to alloy the reactant product elements. The decomposition temperature of iron pentacarbonyl is about 150° C., and the decomposition temperature of molybdenum carbonyl is about 150° C.

The resultant solid, powder material that is obtained by this decomposition can be confirmed by X-ray diffraction to be amorphous iron-molybdenum alloy. The approximate composition will be amorphous $Fe_{50}Mo_{50}$.

EXAMPLE 3

This example demonstrates the formation of an amorphous iron-molybdenum nitrogen composition.

Equimolar amounts of iron pentacarbonyl ($Fe(CO)_5$) and molybdenum carbonyl ($Mo(CO)_6$) may be disposed in a reactor and sealed under an atmosphere of ammonia. The reactor could then be heated to a temperature above the decomposition temperatures of iron pentacarbonyl and molybdenum carbonyl, which is above about 270° C., for a period of time that would insure decomposition of the reactant materials and alloying of the component elements.

The product that would be obtained as a solid powder material will be an amorphous iron-molybdenum-nitrogen alloy of approximate composition $Fe_{40}Mo_{40}N_{20}$, the nitrogen having been derived from the ammonia atmosphere under which the solid products were sealed prior to heating.

EXAMPLE 4

This example describes the formation of an amorphous iron-chromium-molybdenum composition.

The following three organometallic precursor materials could be disposed in a bomb reactor in about the following molar ratios: 1.0 mol equivalent iron dodecarbonyl ($Fe_3(CO)_{12}$), 0.5 mol equivalent chromium carbonyl ($Cr(CO)_6$), and 3 mol equivalents molybdenum carbonyl ($Mo(CO)_6$). The decomposition temperature of iron dodecarbonyl is about 140° C. The decomposition temperature of chromium carbonyl is about 200° C. The decomposition temperature of molybdenum carbonyl is about 150° C.

The reactor may then be sealed under an inert atmosphere and heated to a temperature above about 270° C. for a period of time sufficient to decompose the precursor compounds and to alloy the elements of the amorphous composition.

The solid, powder material that is obtained from this thermal decomposition will be an amorphous iron-chromium-molybdenum material of approximate composition $Fe_3Cr_{0.5}Mo_3$.

EXAMPLE 5

Example 4 above could also have been performed under an atmosphere other than an inert atmosphere so as to modify the product amorphous metal alloy.

The inert atmosphere of Example 4 may be replaced with a phosphorus atmosphere obtained by disposing solid elemental phosphorus, such as red phosphosus, in the reactor with the other precursor compounds and sealing the reactor under a vacuum. At elevated temperatures, the phosphorus would vaporize producing a phosphorus atmosphere during the decomposition of the other precursor compounds. The resultant amorphous metal alloy from the thermal decomposition reaction may have an approximate composition of $PFe_3Cr_{0.5}Mo_3$.

EXAMPLE 6

This example demonstrates the formation of an amorphous tungsten-nickel-carbon composition.

Precursor materials, mesitylene tungsten tricarbonyl ($C_9H_{12}W(CO)_3$) and bis(triphenylphosphine)nickel dicarbonyl[$(C_6H_5)_3P]_2Ni(CO)_2$, may be disposed in a bomb reactor in a molar ratio of about 1:2. The decomposition temperature of mesitylene tungsten tricarbonyl is about 165° C., and the decomposition temperature of bis(triphenylphosphine)nickel dicarbonyl is about 215° C. The reactor may be sealed under an inert atmosphere such as an argon atmosphere and then heated to a temperature above about 215° C. for a time long enough to insure that the precursor compounds have substantially decomposed and alloyed.

A solid, powder material would result that is an amorphous tunsten-nickel-carbon-phosphorus material having an approximate composition of $WNi_2C_{0.5}P$.

EXAMPLE 7

The formation of an amorphous cobalt rhenium composition is described in this example.

The following two organometallic precursor materials may be disposed in a bomb reactor in about the following molar ratios; 1 mol. rhenium carbonyl ($Re_2(CO)_{10}$) and 2 mols cobalt carbonyl ($Co_2(CO)_8$). The reactor may then be sealed under an inert atmosphere, such as an argon atmosphere and heated to about at least 170° C. for a time sufficient to thermally decompose the precursor compounds. The decomposition temperature of rhenium carbonyl is about 170° C. The decomposition temperature of cobalt carbonyl is about 55° C. The resultant solid, powder material that is obtained by this decomposition will be an amorphous alloy of cobalt rhenium. The approximate composition will be amorphous $Co_2Re$.

EXAMPLE 8

The formation of an amorphous tungsten-cobalt-iron composition is described in this example.

The following organometallic precursor materials may be disposed in a bomb reactor in about the following molar ratios; 1 mol equivalent tungsten carbonyl ($W(CO)_6$), 1 mol equivalent cobalt carbonyl ($Co_2(CO)_8$), and 2 mols equivalents iron nonacarbonyl ($Fe_2(CO)_9$). Tungsten carbonyl has a decomposition temperature of about 170° C. Cobalt carbonyl has a decomposition temperature of about 55° C. Iron nonacarbonyl has a decomposition temperature of about 100° C.

The reactor may be sealed under an inert atmosphere and heated to a temperature above about 270° C. so as to substantially thermally decompose the precursor compounds and to alloy the product elements.

The powder removed from the bomb reactor after the co-decomposition of the precursor materials will comprise an amorphous tungsten-cobalt-iron composition of approximately $WCo_2Fe_4$.

EXAMPLE 9

This example demonstrates the formation of an amorphous chromium-iron-nickel-boron composition synthesized by adding a chromium-bearing precursor compount to an amorphous iron-nickel-boron alloy.

Chromium carbonyl ($Cr(CO)_6$) was mixed with a substantially amorphous metal alloy or iron-nickel-boron, having an approximate composition $Fe_2Ni_2B$, in a molar ratio of about 1:2 and were then disposed in a bomb reactor, evacuated and sealed. Chromium carbonyl thermally decomposes at about 200° C. The crystallization temperature of the amorphous $Fe_2Ni_2B$ alloy is about 410° C., its glass transition temperature is about 330° C.

The sealed reactor was heated to about 250° C. and maintained at about that temperature for about 120 hours. Upon cooling and opening the reactor and examining its contents, no chromium carbonyl was found to be present. However, X-ray diffraction analysis determined that the powder that was removed from the reactor after this heat-treating was amorphous, having an approximate composition of $Cr_{0.5}Fe_2Ni_2B$. Thus, the process disclosed herein may include the enhancement of an amorphous metal alloy by further decomposing a metal-bearing precursor compound in the presence of an amorphous metal alloy whereby the metal in the precursor compound is incorporated into the alloy, and which alloy remains substantially amorphous.

The above-described examples demonstrate the formation of amorphous metal alloy compositions by decomposition of precursor metal-bearing materials. The formation of such amorphous materials could only be obtained previously by processes that utilize high temperature, energy intensive equipment. In addition, the novel processes described herein above produce amorphous metal alloy powders, whereas prior art processes yield the amorphous material only in a solid, thin-film or ribbon-like form which must first be reduced to a powder if it is to be formed into a solid shape.

The selection or precursor materials, decomposition temperatures, heat-treating temperatures and other reactant conditions can be determined from the preceeding Specification without departing from the spirit of the invention herein disclosed and described. The scope of the invention is intended to include modifications and variations that fall within the scope of the appended claims.

We claim:

1. A process for the synthesis of a substantially amorphous metal alloy comprising thermally decomposing at least one precursor metal-bearing compound at a temperature below the crystallization temperature of the amorphous metal alloy to be formed, the at least one precursor metal-bearing compound having a decomposition temperature below the crystallization temperature of the amorphous alloy to be formed and containing the metals which comprise the substantially amorphous metal alloy.

2. The process in accordance with claim 1 wherein said substantially amorphous metal alloy is obtained as a power.

3. The process in accordance with claim 2 wherein said powder is further processed into a solid shape.

4. The process in accordance with claim 1 wherein the amorphous metal alloy formed is at least 50 percent amorphous.

5. The process in accordance with claim 1 wherein the amorphous metal alloy formed is at least 80 percent amorphous.

6. The process in accordance with claim 1 wherein the amorphous metal alloy formed is about 100 percent amorphous.

7. The process in accordance with claim 1 wherein said process synthesizes an amorphous metal alloy composition including nonmetallic elements.

8. The process in accordance with claim 7 wherein the thermal decomposition occurs under an atmosphere comprising said nonmetallic elements.

9. The process in accordance with claim 1 wherein the said thermal decomposition occurs at a temperature at least 25° C. below the crystallization temperature of the amorphous metal alloy to be formed.

10. The process in accordance with claim 1 wherein said thermal decomposition occurs at a temperature at least 100° C. below the crystallization temperature of the amorphous metal alloy to be formed.

11. The process in accordance with claim 1 wherein said decomposition temperature is between about 25° C. and about 500° C.

12. The process in accordance with claim 1 wherein said decomposition temperature is between about 250° C. and about 400° C.

13. The process in accordance with claim 1 wherein said thermal decomposition occurs under an inert atmosphere.

14. The process in accordance with claim 1 wherein said decomposition occurs under a reactive atmosphere.

15. The process in accordance with claim 1 wherein said at least one precursor metal-bearing compound is an organometallic compound.

16. The process in accordance with claim 1 wherein said substantially amorphous metal alloy has a maximum particle size of from about 10 Angstroms to about 1000 Angstroms.

17. The process in accordance with claim 1 wherein said substantially amorphous metal alloy has a maximum particle size of from about 10 Angstroms to about 500 Angstroms.

18. A process for the synthesis of an enhanced substantially amorphous metal alloy comprising thermally decomposing at least one precursor metal-bearing compound in the presence of an initial substantially amorphous metal alloy at a temperature below the crystallization temperatures of the initial substantially amorphous metal alloy and the enhanced substantially amorphous metal alloy to be formed, the at least one precursor metal-bearing compound containing additional elements to be incorporated into the initial metal alloy so as to form an enhanced substantially amorphous metal alloy.

19. A process for the synthesis of a substantially amorphous metal alloy comprising the steps of:

(a) decomposing at least one precursor metal-bearing compound at a temperature below the crystallization temperature of the amorphous metal alloy to be synthesized so as to form an intimate mixture of the components of the amorphous metal alloy to be synthesized, the at least one precursor metal-bearing compound containing the metals which comprise the substantially amorphous alloy; and (b) heat-treating the intimate mixture so as to form the substantially amorphous metal alloy.

20. The process in accordance with claim 19 wherein said substantially amorphous metal alloy is synthesized as a powder.

21. The process in accordance with claim 19 wherein prior to step (b) said intimate mixture of the components of the amorphous metal alloy to be synthesized is pressed into a shape.

22. The process in accordance with claim 19 wherein said substantially amorphous metal alloy of step (b) is formed into a solid shape.

23. The process in accordance with claim 17 wherein said formed substantially amorphous metal alloy is at least 50 percent amorphous.

24. The process in accordance with claim 19 wherein said formed substantially amorphous metal alloy is at least 80 percent amorphous.

25. The process in accordance with claim 19 wherein said formed substantially amorphous metal alloy is about 100 percent amorphous.

26. The process in accordance with claim 19 wherein said process synthesizes an amorphous metal alloy composition including nonmetallic elements.

27. The process in accordance with claim 26 wherein heat-treating of the intimate mixture occurs under an atmosphere comprising said nonmetallic elements.

28. The process in accordance with claim 19 wherein said at least one precursor metal bearing compound is decomposed at a temperature at least 25° below the crystallization temperature of the amorphous metal alloy to be synthesized.

29. The process in accordance with claim 19 wherein said at least one precursor metal-bearing compound is decomposed at a temperature at least 100° C. below the crystallization temperature of the amorphous metal alloy to be synthesized.

30. The process in accordance with claim 19 wherein said at least one precursor metal-bearing compound is decomposed at a temperature of between about 25° C. and about 500° C.

31. The process in accordance with claim 19 wherein said at least one precursor metal-bearing compound is decomposed at a temperature of between about 250° C. and about 400° C.

32. The process in accordance with claim 19 wherein said heat-treating of the intimate mixture is performed under an inert atmosphere.

33. The process in accordance with claim 9 wherein said heat-treating of the intimate mixture is performed under a reactive atmosphere.

34. The process in accordance with claim 19 wherein at least one precursor metal-bearing compound is an organometallic compound.

35. The process in accordance with claim 19 wherein said intimate mixture comprises particles having a maximum particle size of from about 10 Angstroms to about 1000 Angstroms.

36. The process in accordance with claim 19 wherein said intimate mixture comprises particles having maximum particles size of from about 10 Angstroms to about 500 Angstroms.

37. A process for the synthesis of an enhanced substantially amorphous metal alloy comprising the steps of:

(a) decomposing at least one precursor metal-bearing compound in the presence of an initial substantially amorphous metal alloy at a temperature below the crystallization temperature of the enhanced substantially amorphous metal alloy to be synthesized so as to form an intimate mixture of the components of the enhanced amorphous metal alloy to be synthesized; and (b) heat-treating the mixture so as to form an enhanced substantially amorphous metal alloy.

38. A substantially amorphous metal alloy powder having a maximum particle size of from about 10 Angstroms to about 1,000 Angstroms synthesized by thermally decomposing at least one precursor metal-bearing compound at a temperature below the crystallization temperature of the amorphous metal alloy, the at least one precursor metal-bearing compound containing the metals that comprise the substantially amorphous metal alloy.

39. The substantially amorphous metal alloy powder in accordance with claim 38 wherein said amorphous metal alloy powder is at least 50 percent amorphous.

40. The substantially amorphous metal alloy powder in accordance with claim 38 wherein said amorphous metal alloy powder is at least 80 percent amorphous.

41. The substantially amorphous metal alloy powder in accordance with claim 38 wherein said amorphous metal alloy powder is about 100 percent amorphous.

42. The substantially amorphous metal alloy powder in accordance with claim 38 wherein the amorphous metal alloy composition includes nonmetallic elements.

43. The substantially amorphous metal alloy powder in accordance with claim 38 wherein the amorphous metal alloy composition includes nonmetallic elements selected from the group comprising boron, carbon, nitrogen, silicon, phosphorus, arsenic, germanium and antimony.

44. The substantially amorphous metal alloy powder in accordance with claim 38 wherein said powder has a maximum particle size of from about 10 Angstroms to about 500 Angstroms.

* * * * *